US007827843B2

(12) United States Patent
Arns et al.

(10) Patent No.: US 7,827,843 B2
(45) Date of Patent: Nov. 9, 2010

(54) DEVICE FOR CONTROLLING THE DRAWING PROCESS IN A TRANSFER PRESS

(75) Inventors: Stefan Arns, Lohr (DE); Helmut Behl, Triefenstein (DE)

(73) Assignee: Bosch Rexroth AG, Stuttgart (DE)

( * ) Notice: Subject to any disclaimer, the term of this patent is extended or adjusted under 35 U.S.C. 154(b) by 1141 days.

(21) Appl. No.: 10/562,612

(22) PCT Filed: Aug. 6, 2004

(86) PCT No.: PCT/EP2004/008807

§ 371 (c)(1),
(2), (4) Date: Jun. 9, 2006

(87) PCT Pub. No.: WO2005/016571

PCT Pub. Date: Feb. 24, 2005

(65) Prior Publication Data

US 2006/0254337 A1 Nov. 16, 2006

(30) Foreign Application Priority Data

Aug. 7, 2003 (DE) ..... 103 36 279

(51) Int. Cl.
*B21J 9/12* (2006.01)
*B21J 9/18* (2006.01)
*B21D 22/21* (2006.01)
*B21D 24/14* (2006.01)

(52) U.S. Cl. ..... 72/453.13; 72/351; 72/453.06

(58) Field of Classification Search ..... 72/351, 72/453.13, 453.01, 453.02, 453.05, 453.06, 72/453.08, 350, 441, 443
See application file for complete search history.

(56) References Cited

U.S. PATENT DOCUMENTS 4,721,028 A * 1/1988 Lucas et al. ..... 91/433

(Continued)

FOREIGN PATENT DOCUMENTS

DE 41 17 102 A1 11/1992

(Continued)

OTHER PUBLICATIONS

Patent Abstracts of Japan, vol. 013, No. 076, Feb. 21, 1989 -&JP 63 273524 (Ishikawajima Harima Heavy Ind. Co. Ltd, Nov. 10, 1988.

(Continued)

*Primary Examiner*—Dana Ross
*Assistant Examiner*—Mohammad Yusuf
(74) *Attorney, Agent, or Firm*—Lucas & Mercanti, LLP

(57) ABSTRACT

A device for controlling the drawing process in a transfer press has two tool parts which act in opposition to one another and between which the workpiece to be deformed is held. One tool part is moved between two reversal points by a mechanical crank mechanism driven at a constant rotational speed. The second tool part is connected to the piston of a hydraulic differential cylinder via a piston rod. The movement of the piston is controlled by the supply of pressure medium into a first chamber and by the discharge of pressure medium out of the second chamber of the differential cylinder. During a first time segment within a range delimited by the first and the second reversal point, the rod-side face of the piston is acted upon by a pressure which is sufficiently high to accelerate the second tool part as that, when the two tool parts impinge one onto the other, both tool parts move virtually at the same speed.

18 Claims, 5 Drawing Sheets

U.S. PATENT DOCUMENTS

| | | | | |
|---|---|---|---|---|
| 5,339,665 | A | 8/1994 | Yoshikawa | |
| 5,435,166 | A * | 7/1995 | Sunada | 72/351 |
| 5,966,981 | A * | 10/1999 | Janos et al. | 72/350 |
| 6,085,520 | A * | 7/2000 | Kohno | 60/414 |
| 6,145,307 | A | 11/2000 | Dantlgraber | |
| 6,205,828 | B1 * | 3/2001 | Nagao et al. | 72/453.13 |
| 6,279,370 | B1 * | 8/2001 | Awad | 72/453.02 |

FOREIGN PATENT DOCUMENTS

| | | |
|---|---|---|
| DE | 43 09 641 A1 | 9/1993 |
| DE | 196 39 220 A1 | 3/1998 |
| EP | 1 138 406 | 10/2001 |

OTHER PUBLICATIONS

Patent Abstracts of Japan, vol. 013, No. 252, Jun. 12, 1989 -&JP 01 057926 (Ishikawajima Harima Heavy Ind. Co Ltd, Mar. 6, 1989.

* cited by examiner

DEVICE FOR CONTROLLING THE DRAWING PROCESS IN A TRANSFER PRESS

The invention relates to a device for controlling the drawing process in a transfer press.

In a press in the form of a transfer press, a workpiece to be deformed is held between two tool parts acting in opposition to one another. One of the two tool parts, which is formed particularly as a negative mold, is movable between an upper and a lower reversal point by a mechanical crank mechanism driven at a constant rotational speed. In this case, the movement from the upper to the lower reversal point is designated as a prestroke, and the subsequent movement from the lower to the upper reversal point is designated as the return stroke. The movement of the tool part driven by the crank mechanism is predetermined by the design of the crank mechanism and by its rotational speed. During one work cycle of the drawing process, said work cycle comprising prestroke and return stroke, the crank mechanism executes one complete revolution. Since the rotational speed of the crank mechanism is constant, there is a fixed relation between the crank angle and the time. It is thus possible, instead of the respective crank angles, to consider time points corresponding to these. The following description also makes use of this relation. The other tool part, which is formed particularly as a drawing cushion, is connected via a piston rod to the piston of a hydraulic differential cylinder. The movement of the piston rod is controlled by the supply of pressure medium into a first chamber of the differential cylinder and by the discharge of pressure medium out of the other chamber in each case. The movement of the tool part held on the piston rod can be influenced, independently of the movement of the crank mechanism, by controlling the flow of pressure medium to and from the differential cylinder. A work cycle of the drawing process of the press is divided into a series of successive time segments. During a first time segment, which extends within the prestroke in the selected example, the rod-side face of the piston is acted upon by pressure medium in such a way that the differential cylinder accelerates a second tool part to an extent such that, when the first tool part impinges on the second tool part, both tool parts move virtually at the same speed. In a second time segment, which follows the first time segment within the prestroke and which extends as far as the lower reversal point, the two tool parts bear from mutually opposite sides against the workpiece and deform the latter. During deformation, the two tool parts approach one another even further. At the lower reversal point, a decompression of the pressure medium in the differential cylinder takes place. With the reversal in direction of movement of the crank mechanism, the return stroke commences with a further time segment which extends at most until the upper reversal point is reached. In this time segment, the second tool part can either move into a particular extraction position or first move, together with the crank mechanism, in the direction of the upper reversal point. In both instances, the speed of the second tool part driven by the differential cylinder is no higher than the speed of the tool part driven by the crank mechanism. The pump provided for supplying the differential cylinder with pressure medium must be designed such that it is capable of accelerating the second tool part during the first time segment, as described above. This time segment is the time segment with the highest pressure medium requirement during a work cycle. Since the pump has to be designed for the highest pressure medium requirement, it is overdimensioned for time segments with a lower pressure medium requirement and consumes more energy than is necessary in these time segments. Such devices for controlling the drawing process in a transfer press have been offered and sold by Mannesmann Rexroth AG (now trading as Bosch Rexroth AG).

SUMMARY OF THE INVENTION

The object on which the invention is based is to improve the device initially mentioned for controlling the drawing process, with the aim of reducing the energy requirement.

This object is achieved by means of the features of the invention. The invention makes use of the consideration that a high pressure is required only during the first time segment of the drawing process, and that, in at least one further time segment of a work cycle, a pressure lower than this pressure is sufficient for the movement of the second tool part. Although the use of a low-pressure pump, necessary for this purpose, increases the initial costs of the press, these extra costs are more than compensated, however, by savings in operating costs, and therefore, over the entire useful life of the press, the energy saving is predominant.

Advantageous developments of the invention are characterized in the subclaims. They relate to measures which lead to a further energy saving, and to details of devices of this type. By virtue of these measures, inter alia, a cylinder having a smaller construction size may be used. Moreover, the cooling capacity required decreases. A tank having smaller dimensions may be used for the pressure medium.

BRIEF DESCRIPTION OF THE DRAWINGS

The invention is explained in more detail below, together with its further particulars, by means of three exemplary embodiments illustrated in the drawings in which.

DETAILED DESCRIPTION OF THE PREFERRED EMBODIMENT(S)

Figure 1:
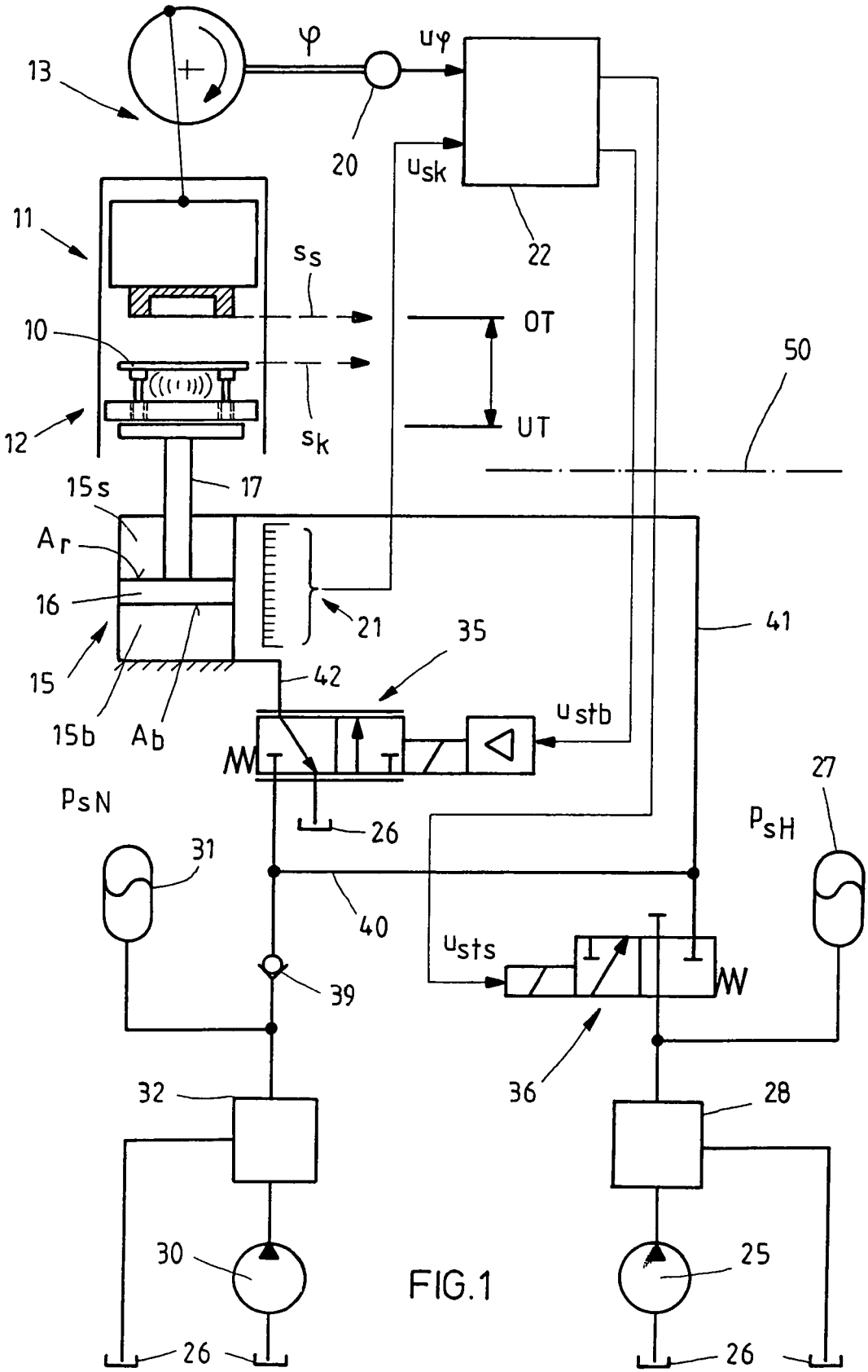
FIG. 1 shows a diagrammatic illustration of a first device, formed according to the invention, for controlling the drawing process in a transfer press.

FIG. 1 shows a diagrammatic illustration of a transfer press and of a first device for controlling the drawing process according to the invention. A workpiece 10 to be deformed is held between two tool parts 11 and 12 which act in opposition to one another and of which the tool part 11 is formed as a negative mold and the tool part 12 has a drawing cushion. A mechanical crank mechanism 13 driven at a constant rotational speed by a motor, not illustrated in FIG. 1, moves the tool part 11 between an upper reversal point OT and a lower reversal point UT, the lower limit of the tool part 11 being designated as reference position s. A hydraulic differential cylinder 15 with a piston 16 and with a piston rod 17 engaging on the tool part 12 moves the tool part 12 within the range delimited by the reversal points OT and UT. The upper limit of the tool part 12 is in this case designated as reference position $s_k$. A rotary-angle transducer 20 converts the angular position $\phi$ on the crank mechanism 13, said angular position being a measure of the position $s_s$ of the tool part 11, into an electrical voltage signal $u_\phi$. A displacement transducer 21, illustrated symbolically by a ruler, converts the position $s_k$ of the tool part 12 into a further voltage signal $u_{sk}$. The voltage signals $u_\phi$ and $u_{sk}$ are fed as input signals to a computing circuit 22. The computing circuit 22 links the input signals, according to predetermined algorithms, to form control signals $u_{stb}$ and $u_{sts}$ which control the supply of pressure medium to the chambers of the differential cylinder 15, said chambers being given the reference symbols 15*s* and 15*b*.

A first pump 25, formed as a fixed-displacement pump, conveys pressure medium out of a tank 26 and charges a pressure accumulator 27 to a pressure $p_{sH}$, the magnitude of which is limited by a pressure cutoff valve 28. A further pump 30, likewise formed as a fixed-displacement pump, conveys pressure medium out of the tank 26 and charges a further pressure accumulator 31 to a pressure $p_{sN}$, the magnitude of which is limited by a further pressure cutoff valve 32. The pressure $p_{sH}$ is selected such that the tool part 12 can be moved at the maximum acceleration required during operation. The pressure $p_{sN}$ is markedly lower than the pressure $p_{sH}$. In an exemplary embodiment, $p_{sN}$ is of the order of one quarter of $p_{sH}$.

Figure 5:
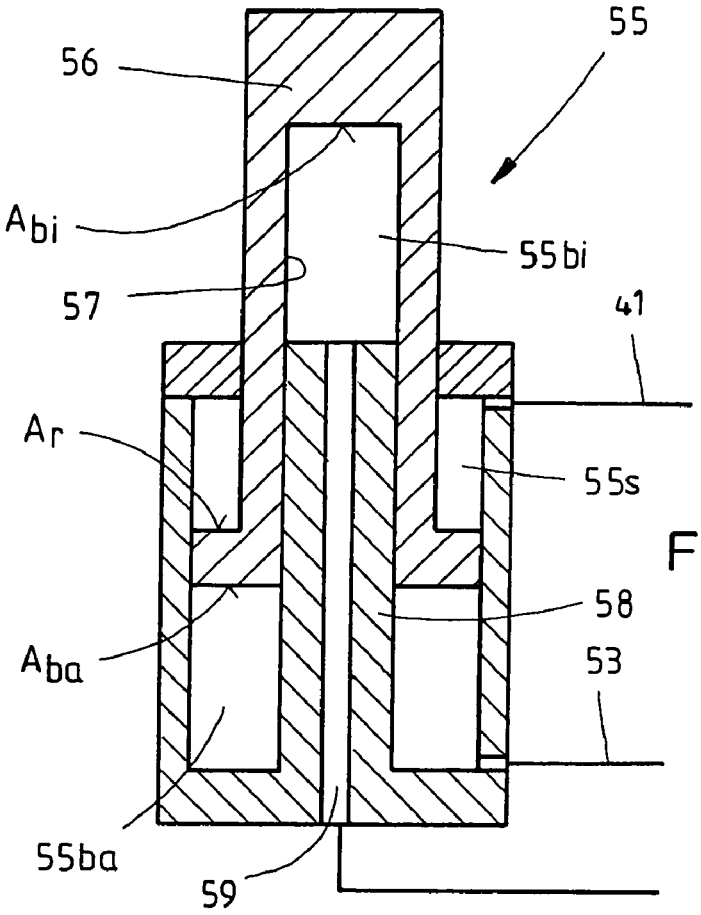
FIG. 5 shows an enlarged illustration of a cylinder used in FIG. 4.

A proportional valve 35 and a switching valve 36 controls the supply of pressure medium from the pressure accumulators 27 and 31 to the chambers 15*s* and 15*b* of the differential cylinder 15 according to the control signals $u_{stb}$ and $u_{sts}$ transmitted by the computing circuit 22. A pressure accumulator 31 is connected to the rod-side chamber 15*s* of the differential cylinder 15 via a nonreturn valve 39 and via hydraulic lines 40 and 41. In the position of rest of the valve 35, as illustrated in FIG. 1, this being one of the two end positions of this valve, the chamber 15*b* is connected to the tank 26 via a further hydraulic line 42. The connection between the nonreturn valve 39 and the chamber 15*b* is shut off in the position of rest of the valve 35. When the valve 36, too, is in the position of rest illustrated in FIG. 5, the connection between the pressure accumulator 27 and the line 41 is shut off, and the chamber 15*s* is acted upon only by the pressure $p_{sN}$ of the pressure accumulator 31. In the other end position of the valve 35, which corresponds to the maximum value of the control signal $u_{stb}$, the chamber 15*b* is also acted upon by the pressure $p_{sN}$ in addition to the chamber 15*s*. In the case of values of the control signal $u_{stb}$ which lie between zero and its maximum value, the chamber 15*b* is connected both to the tank 26 and to the line 40, the size of the respective passage cross sections being determined by the respective magnitude of the control signal $u_{stb}$.

When the valve 36 is in the working position, the chamber 15*s* is acted upon by the pressure $p_{sH}$ and the pressure $p_{sH}$ acts on the face $A_r$. The nonreturn valve 39 shuts off, since, as described above, $p_{sH}$ is higher than $p_{sN}$. When the valve 35 is in the position of rest, the chamber 15*b* is relieved to the tank 26. In these positions of the valves 35 and 36, the highest downwardly directed force acts on the piston 16. In the event of an increase in the control signal $u_{stb}$, the connection to the tank 26 is throttled. Then, an upwardly directed force determined by the magnitude of the control signal $u_{stb}$ acts on the face $A_b$ of the head of the piston 16, said force counteracting the downwardly acting force and consequently reducing the resultant downwardly acting force.

Figure 2:
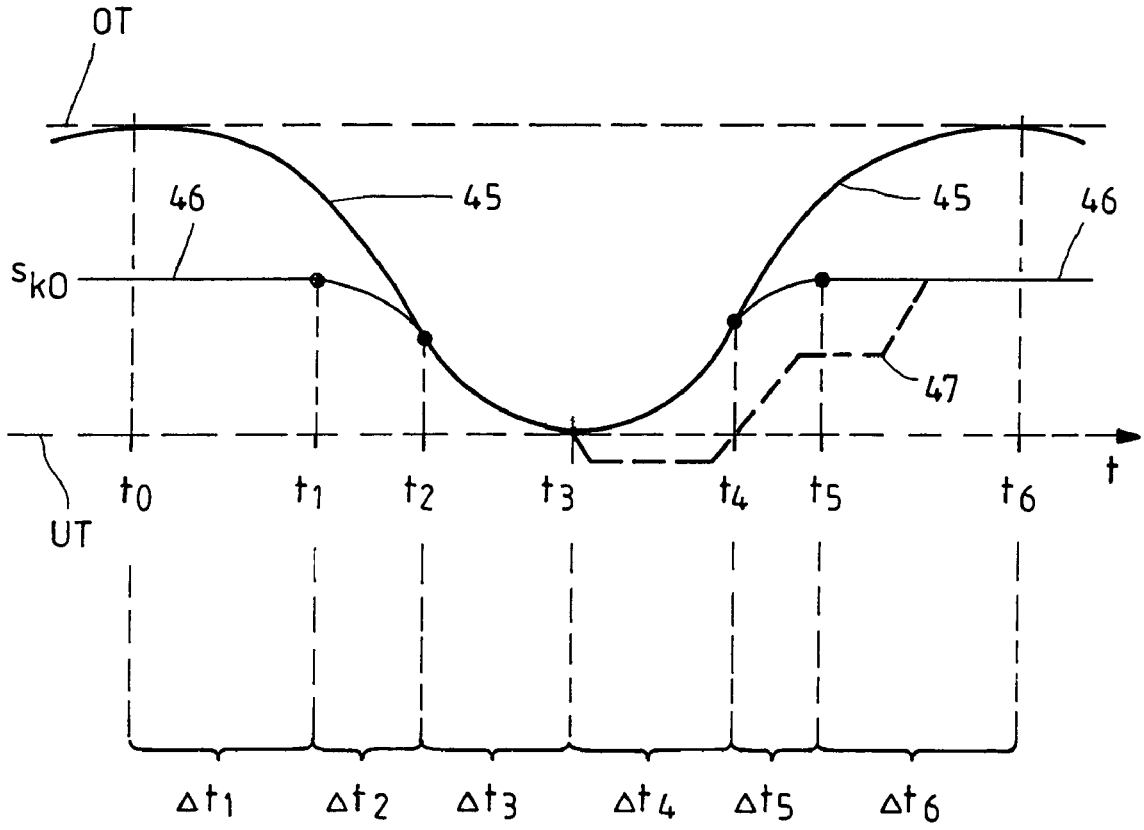
FIG. 2 shows a graph, in which the movement of the two tool parts of the transfer press illustrated in FIG. 1 during the individual time segments of a work cycle is illustrated.

The functioning of a transfer press in the control device illustrated in FIG. 1 is described below with reference to FIG. 2. FIG. 2 shows the position $s_5$ of the tool part 11 (curve trace 45) and the position $s_k$ of the tool part 12 (curve trace 46) during a work cycle of the transfer press. Since the rotational speed of the crank mechanism 13 is constant, there is a fixed relation between the crank angle $\phi$, which is a measure of the position $s_s$, and the time t. It is consequently possible, instead of the respective crank angles $\phi_i$, to consider time points $t_i$ corresponding to these. The work cycle described below commences at the time point $t_0$ with a prestroke in which the tool part 11 moves from the upper reversal point OT to the lower reversal point UT. This reversal point is reached at the time point $t_3$. The prestroke is followed by a return stroke, in which the tool part 11 moves back from the lower reversal point UT to the upper reversal point OT. This reversal point is reached at the time point $t_6$. Owing to the continuous rotational movement of the crank mechanism, a new work cycle commences immediately at the time point $t_6$ and proceeds in the same way as the work cycle between the time points $t_0$ and $t_6$. In contrast to the movement of the tool part 11, the movement of which is permanently determined by the crank mechanism 13, the movement of the tool part 12 can be controlled by the action of hydraulic pressure medium upon the chambers 15*b* and 15*s* of the differential cylinder 15. For this purpose, a program is filed in the computing circuit 22, which, from the signals $u_\phi$ and $u_{sk}$, forms control signals $u_{stb}$ and $u_{sts}$ for the valves 35 and 36 in such a way that the position $s_k$ of the tool part 12 corresponds to the curve trace 46. At the time point $t_0$, the valve 36 is in its working position, that is to say the chamber 15*s* is acted upon by the pressure $p_{sH}$. Up to the time point $t_1$, the valve 35 is activated such that the tool part 12 maintains its initial position, designated by $s_{k0}$. In this case, in the chamber 15*b*, a pressure is established at which the forces acting on the piston 16 from opposite sides exactly cancel one another (taking into account the dead weight of the tool part 12 and of the workpiece 10). On account of the movement of the tool part 11, the distance between the tool parts 11 and 12 decreases in the time segment $\Delta t_1$ between $t_0$ and $t_1$. From the time point $t_1$ on, the computing circuit 22 activates the valve 35 in such a way that the distance between the tool parts 11 and 12 decreases further, until the tool parts 11 and 12 impinge one on the other at the time point $t_2$. At the time point $t_2$, the computing circuit 22 switches the valve 36 back into its position of rest. The energy consumption of the pump 25 is consequently reduced, since only the pressure $p_{sH}$ of the pressure accumulator 27 is maintained, without pressure medium being extracted from the pressure accumulator 27. For the remaining part of the prestroke, that is to say in the time segment $\Delta t_3$ between the time points $t_2$ and $t_3$, and during a first part of the return stroke, for example during the time segments $\Delta t_4$ and $\Delta t_5$ between the time point t3 and t5, the valve 36 maintains its position of rest. During this time, the chambers 15*b* and 15*s* of the differential cylinder 15 are acted upon only by pressure medium from the pressure accumulator 31. In this case, the computing circuit 22 again activates the valve 35 such that, in the chamber 15*b*, a pressure is established which acts on the face $A_b$ of the piston 16 and, together with the other forces acting on the piston 16, moves the tool part 12 according to the profile of the curve trace 46. The curve trace 46 applies to a situation where the tool parts 11 and 12, together with the workpiece 10 located between them, move jointly upward as far as the time point $t_4$. In the time segment $\Delta t_5$, which extends as far as the time point $t_5$, the tool parts 11 and 12 separate from one another and release the workpiece 10 for extraction. At the time point $t_5$, the tool part 12 has reached its initial position $s_{k0}$, while the tool part 11 is still moving up to the upper reversal point OT which it reaches at the time point $t_6$. At the time point $t_6$, the computing circuit 22 switches the valves 36 again into its working position, in which the pressure $p_{sH}$ is supplied to the chambers of the differential cylinder 15 via the lines 40 and 41. In principle, the changeover of the valve 36 into its working position may also take place at a later time point, but at the latest up to the time point $t_1$. The dashed line 47 shows, alternatively to the curve trace 46, the situation where the tool part 12 first moves, from the time point $t_3$ on, into a particular extraction position to the workpiece 10 and reaches its initial position $s_{k0}$ again only between the time points $t_5$ and $t_6$.

Figure 3:
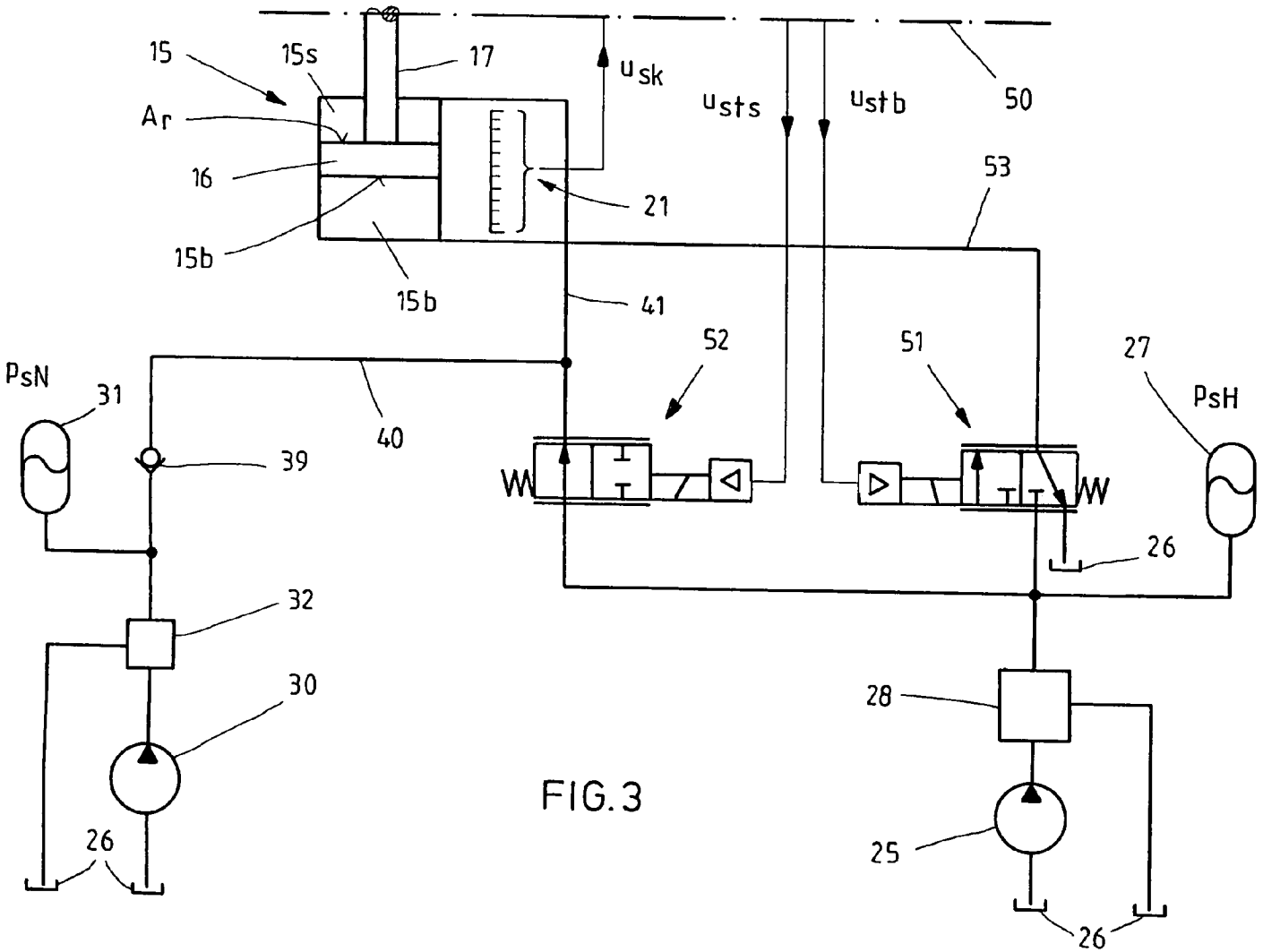
FIG. 3 shows the hydraulic part of a second device, formed according to the invention, for controlling the drawing process in a transfer press.

FIG. 3 shows only the hydraulic part of a second device, formed according to the invention, for controlling the drawing process in a transfer press. This device is identical in many parts to the device illustrated in FIG. 1. Components which are illustrated above a dashed and dotted line 50 in FIG. 1, to be precise the tool parts 11 and 12, the crank mechanism 13 and the computing circuit 22, are also not illustrated once more in FIG. 3 for the sake of clarity. The piston rod 17 of the differential cylinder 15, said piston rod ending at the line 50 in FIG. 3, leads to the tool part 12. The output signal $u_{sk}$ from the displacement transducer 21 is fed as an input signal to the computing circuit 22. The output signal $u_{\varphi}$ of the rotary-angle transducer 20 is fed as a further input signal to the computing circuit 22. From these signals, the computing circuit 22 forms the control signal $u_{stb}$ for a hydraulic valve 51 and the control signal $u_{sts}$ for a further hydraulic valve 52. The valves 51 and 52 are formed as proportional valves. This measure allows a sensitive control of the pressure medium flow. The valve 51, which is connected to the chamber 15*b* via a hydraulic line 53, controls the flow of pressure medium to the bottom-side chamber 15*b*. The valve 52 controls the flow of pressure medium to the rod-side chamber 15*s*. As in FIG. 1, two pumps 25 and 30, two pressure cutoff valves 28 and 32, two pressure accumulators 27 and 31 and a nonreturn valve 39 are provided in FIG. 3. The pressure accumulator 31 is connected to the chamber 15*s* via the nonreturn valve 39 and the lines 40 and 41.

The valve 51 can be controlled continuously between two end positions by means of the control signal $u_{stb}$. In the end position illustrated in FIG. 3, the chamber 15*b* is relieved to the tank 26. In the other end position of the valve 51, the chamber 15*b* is acted upon by the pressure $p_{sH}$. In the case of values of the control signal $u_{stb}$ which lie between zero and its maximum value, the valve 51 assumes an intermediate position, in which the chamber 15*b* is connected both to the tank 26 and to the pressure accumulator 27, the size of the respective passage cross sections being determined by the respective value of the control signal $u_{stb}$. The valve 52 can likewise be controlled continuously between two end positions by means of the control signal $u_{sts}$. In the end position illustrated in FIG. 3, the chamber 15*s* is acted upon by the pressure $p_{sH}$. Since the pressure $p_{sH}$ is higher than the pressure $p_{sN}$ in this position of the valve 52, the nonreturn valve 39 shuts off. In its other end position, the valve 52 shuts off and the chamber 15*s* is acted upon by the pressure $p_{sN}$. In the intermediate positions of the valve 52, the pressure in the chamber 15*s* is established at a value which lies between $p_{sH}$ and $p_{sN}$ and which is dependent on the magnitude of the control signal $u_{sts}$.

The computing device 22 activates the valves 51 and 52 such that the tool part 12 connected to the piston rod 17 follows the curve trace 46 illustrated in FIG. 2. The work cycle commences at the time point $t_0$ with a prestroke, in which the tool part 11 moves from the upper reversal point OT to the lower reversal point UT. In a time segment $\Delta t_2$ between the time points $t_1$ and $t_2$, the valves 51 and 52 are in the position of rest, illustrated in FIG. 3, in which the chamber 15*s* is acted upon by the pressure $p_{sH}$ and the chamber 15*b* is relieved to the tank 26. In this valve position combination, the highest possible force acts on the piston 16. At the time point $t_2$ at which the tool part 11 impinges onto the tool part 12, the valve 52 closes. The chamber 15*s* is acted upon with pressure medium by the pressure accumulator 31 via the nonreturn valve 39 and the lines 40 and 41. The tool part 11 driven by the crank mechanism 13 displaces the tool part 11 held on the piston rod 17 actively downward. The computing circuit 22 in this case activates the valve 51 such that the desired holding counterforce of the tool part 12 is established. In this case, a reduction in the passage cross section of the connection between the chamber 15*b* and the tank 26 increases the holding counterforce of the tool part 12. The valve 51 to that extent acts with a controllable throttle which determines the pressure in the bottom-side chamber 15*b*. At the time point $t_3$, the tool part 12 reaches the lower reversal point $u_t$. The computing circuit 22 then activates the valves 51 and 52 such that both the chamber 15*b* and the chamber 15*s* are acted upon by the pressure $p_{sH}$. In this case, the valves 51 and 52 are activated, in particular, such that the tool part 12 follows the curve trace 46. Here, too, in the time segment $\Delta t_2$, the differential cylinder 15 is supplied with pressure medium only from the pressure accumulator 31 charged to the lower pressure $p_{sN}$. This means that, in this exemplary embodiment, too, the energy consumption of the pump 25 is reduced in the time segment $\Delta t_2$, as compared with other time segments of the work cycle.

Figure 4:
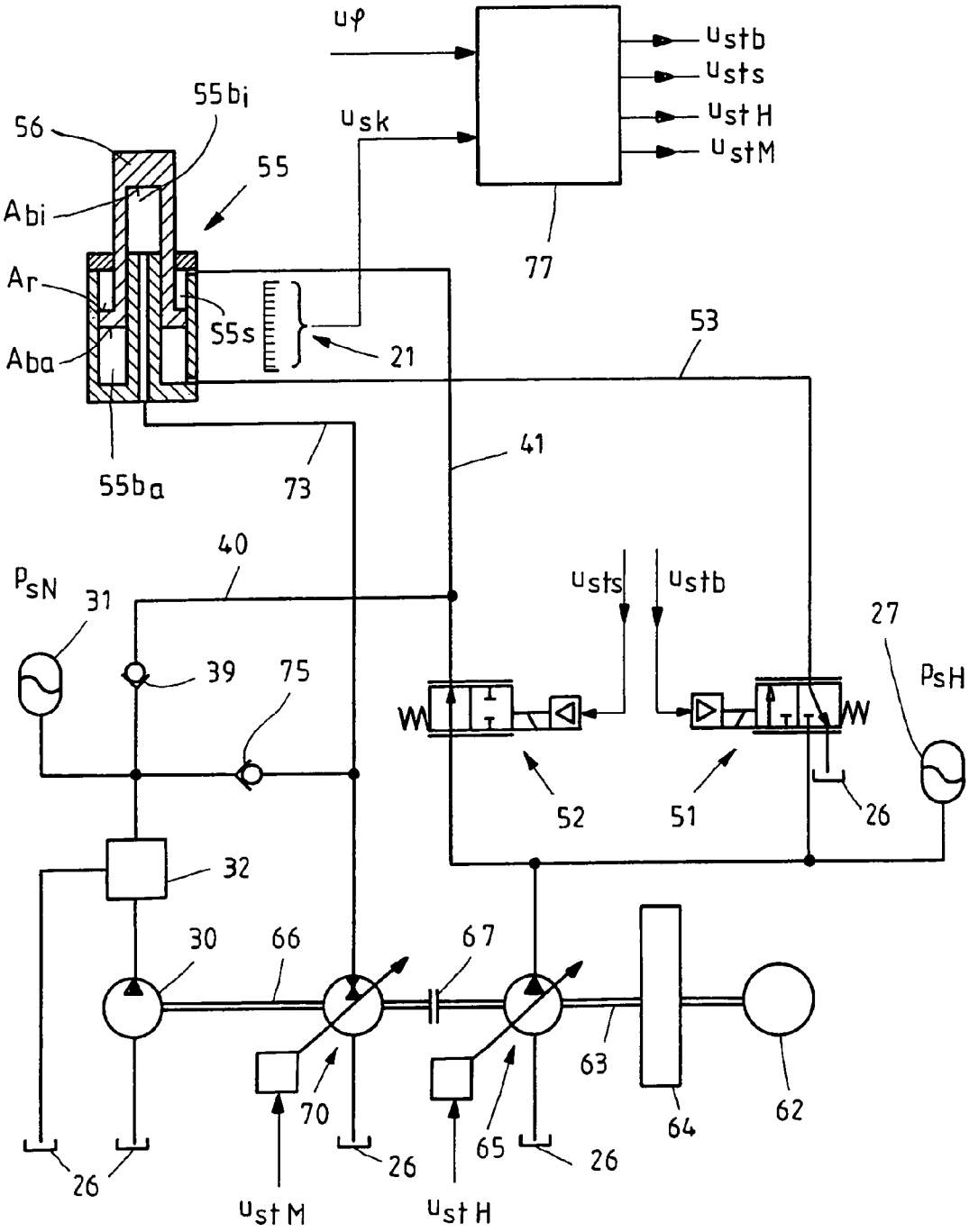
FIG. 4 shows the hydraulic part of a third device, formed according to the invention, for controlling the drawing process in a transfer press.
Figure 6:
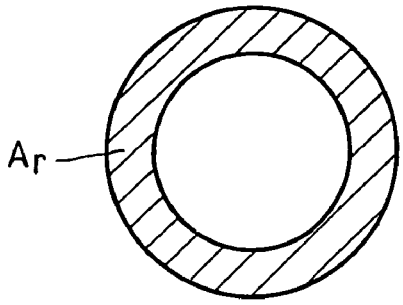
FIG. 6 shows the rod-side annular face, acted upon by pressure medium, of the cylinder illustrated in FIG. 5.
Figure 7:
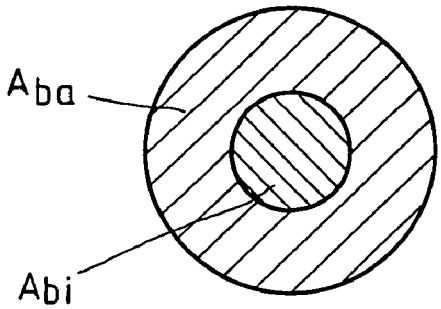
FIG. 7 shows the bottom-side faces, acted upon by pressure medium, of the cylinder illustrated in FIG. 5.

A further reduction in the energy consumption during a work cycle of the transfer press is made possible by the exemplary embodiment described with reference to FIGS. 4 to 7. FIG. 4 shows a control device in an illustration corresponding to FIGS. 1 and 3. In so far as the same components are used in FIGS. 1, 3 and 4, they are given the same reference symbols. For driving the tool part 12, in FIG. 4, there is a differential cylinder 55 which has a construction other than that of the differential cylinder 15 used in FIGS. 1 and 3. As already in FIG. 3, the tool parts 11 and 12 and also the crank mechanism 13 are not illustrated once more in FIG. 4. The differential cylinder 55 is illustrated on an enlarged scale in FIG. 5. A differential cylinder of this type is known, for example, in conjunction with a commercial vehicle, from U.S. Pat. No. 6,145,307. The differential cylinder 55 possesses a piston 56 which is provided with a bore 57. A piston 58 which is fixed with respect to the housing and engages into the bore 57 forms, together with the bore 57, an inner bottom-side chamber $55b_i$. The supply of pressure medium to the chamber $55b_i$ takes place via a duct 59 in the piston 58. Furthermore, the differential cylinder 55 possesses an outer bottom-side chamber $55b_a$ and a rod-side chamber 55*s*. The lines 41 (coming from the valve 52) and 53 (coming from the valve 51) are connected to the chambers 55*s* and $55b_a$ respectively. The pressure-loaded faces of the piston 56 are designated by $A_r$, $A_{bi}$ and $A_{ba}$. FIG. 6 shows the annular face $A_r$ of the rod-side chamber 55*s*. FIG. 7 shows the annular face $A_{ba}$ of the outer bottom-side chamber $55b_a$ and a circular face $A_{bi}$ of the inner bottom-side chamber $55b_i$, the circular face $A_{ba}$ being formed so as to be larger than the annular face $A_{bi}$. An electric motor 62 drives a flywheel mass 64 and a variable-displacement pump 65 via a shaft 63. The conveying volume of the variable-displacement pump 65 is adjustable between a minimum value and a maximum value by means of a control signal $u_{stH}$. A second shaft 66 is connected to the shaft 63 via a coupling 67. The shaft 66 drives a hydraulic machine 70, which can be controlled continuously from pump operation to motor operation as a function of a control signal $u_{stM}$, and the pump 30 formed as a fixed-displacement pump. The hydraulic machine 70 is connected via a hydraulic line 73 to the duct 59, leading into the chamber 55$b_i$, in the piston 58 of the differential cylinder 55, said piston being fixed with respect to the housing. Between the pressure accumulator 31 and the line 73 is arranged a nonreturn valve 75 which shuts off whenever the pressure in the line 73 is higher than $p_{sN}$.

From the input signals $u_\phi$ and $u_{sk}$, a computing circuit 77 forms, according to predetermined algorithms, the control signals $u_{stb}$ and $u_{sts}$ (in the valves 51 and 52) and further control signals $u_{stH}$ (for the variable-displacement pump 65) and $u_{stM}$ (for the hydraulic machine 70). For the sake of clarity, the individual electrical lines between the computing circuit 77 and the actuating members (valves 51 and 52, variable-displacement pump 65, hydraulic machine 70) are not illustrated in FIG. 4. The computing circuit 77 activates the actuating members such that, in this exemplary embodiment, too, the position $S_k$ of the tool part 12 corresponds to the curve trace 46 illustrated in FIG. 2. The work cycle commences again at the time point $t_0$ with a prestroke, in which the tool part 11 moves from the upper reversal point OT to the lower reversal point UT. In the time segment $\Delta t_2$ between the time points $t_1$ and $t_2$, the valves 51 and 52 are in the position of rest, illustrated in FIG. 3, in which the chamber 55*s* is acted upon by the pressure $p_{sH}$ and the chamber 55$b_a$ is relieved to the tank 26. In this time segment, the hydraulic machine 70 is set at approximately 50% tank conveyance. In this combination, the highest possible force acts on the piston 56. At the time point $t_2$ at which the tool part 11 impinges onto the tool part 12, the valve 52 closes. During the time segment $\Delta t_3$, the chamber 55*s* is acted upon with pressure medium by the pressure accumulator 31 via the nonreturn valves 39 and the lines 40 and 41. The tool part 12 held on the piston 56 is actively displaced downward by the crank mechanism 13 via the tool part 11 and the workpiece 10 located between the tool parts 11 and 12. In this time segment, the computing circuit 77 activates the valve 51 such that the desired holding counterforce of the tool part 12 is established. In this case, a reduction in the passage cross section of the connection between the chamber 55$b_a$ and the tank 26 increases the holding counterforce of the tool part 12. The hydraulic machine 70 operates as a motor and transmits mechanical energy to the flywheel mass 64. The variable-displacement pump 65 pivots to 100% conveying volume. The pressure in the chamber 55$b_a$ is regulated via the valve 51 and the hydraulic machine 70. At the time point $t_3$, the tool part 12 reaches the lower reversal point UT. The computing circuit 77 then activates the valves 51 and 52 such that both the chamber 55$b_a$ and the chamber 55$_s$ are acted upon by the pressure $p_{sH}$. Moreover, the chamber 55$b_i$ is filled via the nonreturn valve 75 and the hydraulic machine 70 operated for this purpose as a pump by the computing circuit 77. The actuating members (valves 51 and 52, variable-displacement pump 65, hydraulic machine 70) are activated, in particular, such that the tool part 12 follows the curve trace 46. Here, too, in the time segment $\Delta t_2$, the differential cylinder 55 is not supplied with pressure medium from the pressure accumulator 27 charged to the higher pressure $p_{sH}$. This means that, in this exemplary embodiment, too, the energy consumption of the pump 25 in the time segment $\Delta t_2$ is reduced, as compared with the other time segments of the work cycle, an even better utilization of the energy employed for supplying the electric motor 62 being afforded by the use of the hydraulic machine 70.

The invention claimed is:

1. A device for controlling a drawing process in a transfer press, with two tool parts which act in opposition to one another and between which a workpiece to be deformed is held and of which one tool part, in particular a negative mold, can be moved between two reversal points, of which tool parts the first is assigned to the commencement of a work cycle, by a mechanical crank mechanism driven at a constant rotational speed, and of which the second tool part, in particular a drawing cushion, is connected via a piston rod to the piston of a hydraulic differential cylinder, wherein the movement of the piston is controlled by the supply of pressure medium into a first chamber and by the discharge of pressure medium out of a second chamber of the differential cylinder, and in which, during a first time segment which extends within a range delimited by the first and the second reversal point, the rod-side face of the piston is acted upon by a pressure which is sufficiently high to accelerate the second tool part in such a way that, when the first tool part and the second tool part impinge one onto the other, both tool parts move at virtually the same speed, and in which a controllable throttle arranged between a bottom-slide chamber of the differential cylinder and a tank determines the pressure in the bottom-side chamber, wherein, in a second time segment ($\Delta t_3$) which follows the first time segment ($\Delta t_2$) and extends until the second reversal point (UT) is reached, the rod-side face ($A_r$) of the piston (16; 56) is acted upon by a second pressure ($p_{sN}$) which is lower than the pressure ($p_{sH}$) during the first time segment ($\Delta t_2$), further comprising two pressure accumulators (27, 31), of which one (27) is charged to the first pressure ($p_{sH}$) and the second (31) is charged to the second pressure ($p_{sN}$), and wherein the pressure accumulators are selectively and alternatively connected to a common port of the differential cylinder so that the action of pressure medium upon the rod-side chamber (15*s*; 55*s*) at the differential cylinder (15; 55) takes place from the same pressure accumulator (27, 31) which is charged to the pressure ($p_{sH}$, $p_{sN}$) provided for the respective time segment ($\Delta t_2$, $\Delta t_3$, $\Delta t_4 + \Delta t_5$).

2. The device as claimed in claim 1, wherein the rod-side face ($A_r$) of the piston (16; 56) is acted upon by the first pressure ($p_{sH}$) again in a third time segment ($\Delta t_4 + \Delta t_5$) of the work cycle, which third time segment commences with the reversal in the direction of movement of the crank mechanism (13) and ends at the latest at the time point ($t_6$) in which the crank mechanism (13) reaches the first reversal point (OT).

3. The device as claimed in claim 1, wherein the rod-side face ($A_r$) of the piston (16; 56) is acted upon, further, by the second pressure ($p_{sN}$) in a third time segment ($\Delta t_4 + \Delta t_5$) of the work cycle, which third time segment commences with the reversal in the direction of movement of said piston and ends at the latest at the time point ($t_6$) at which the crank mechanism (13) reaches the first reversal point (OT).

4. The device as claimed in claim 1, wherein the second pressure accumulator (31) is connected to the rod-side chamber (15s; 55s) of the differential cylinder (15; 55) via a nonreturn valve (39).

5. The device as claimed in claim 4, wherein there is arranged, in the line (42; 53) leading to the bottom-side chamber (15*b*; 55$b_a$) of the differential cylinder (15; 55), a proportional valve (35; 51) which serves as a controllable throttle and which controls the flow of pressure medium from one of the pressure accumulators (27, 31) to the bottom-side chamber (15*b*; 55$b_a$) of the differential cylinder (15; 55) and from this chamber to the tank (26).

6. The device as claimed in claim 1, wherein a first pump (25; 65) maintains the pressure ($P_{sH}$) in the first pressure accumulator (27), and a second pump (30) maintains the pressure ($p_{sN}$) in the second pressure accumulator (31).

7. The device as claimed in claim 6, wherein the pumps (25, 30) are fixed-displacement pumps, and pressure cutoff valves (28, 32) are arranged respectively between a pump (25, 30) and the corresponding pressure accumulator (27, 31).

8. The device as claimed in claim 6, wherein the pumps (65) are variable-displacement pumps.

9. The device as claimed in claim 1, wherein there is arranged between the first pressure accumulator (27) and the rod-side chamber (15*s*; 55*s*) of the differential cylinder (15; 55) a valve (36; 52) which controls the pressure medium flow and the outlet connection of which issues into the line (40, 41) leading from the nonreturn valve (39) to the rod-side chamber (15*s*; 55*s*).

10. The device as claimed in claim 9, wherein the valve arranged between the first pressure accumulator (27) and the rod-side chamber (15*s*; 55*s*) of the differential cylinder (15; 55) is a switching valve (36).

11. The device as claimed in claim 9, wherein the valve arranged between the first pressure accumulator (27) and the rod-side chamber (15*s*; 55*s*) of the differential cylinder (15; 55) is a proportional valve (52).

12. The device as claimed in claim 5, wherein the bottom-side face of the piston (56) of the differential cylinder (55) is divided into two part faces ($A_{ba}$, $A_{bi}$) of different size, which are acted upon by pressures ($p_{ba}$, $p_{bi}$) of different magnitude, that the pressure ($p_{ba}$) which acts upon the larger part face ($A_{ba}$) is controlled by the proportional valve (51), and that the pressure ($p_{bi}$) which acts upon the smaller part face ($A_{bi}$) is controlled by a hydraulic machine (70) controllable continuously from pump operation to motor operation.

13. The device as claimed in claim 12, wherein the piston (56) of the differential cylinder (55) is provided with a bore (57), into which a piston (58) fixed with respect to the housing engages, and that the supply of pressure medium to the inner bottom-side chamber (55$b_i$) formed from the bore (57) and the piston (58) fixed with respect to the housing takes place via a duct (59) in the piston (58) fixed with respect to the housing.

14. The device as claimed in claim 12, wherein an electric motor (62) driven the pumps (30, 65) and the hydraulic machine (70) via a common shaft (63, 66), and that a flywheel mask (64) is connected to the shaft (63).

15. The device as claimed in claim 12, wherein the pressure ($p_{bi}$) which acts upon the smaller part face ($A_{bi}$) is controlled such that it is lower than the first pressure ($p_{sH}$) in the first time segment ($\Delta t_2$) and is equal to the second pressure ($p_{sN}$) in the second time segment ($\Delta t_3$).

16. The device as claimed in claim 15, wherein the pressure ($p_{bi}$) which acts upon the smaller part face ($A_{bi}$) is controlled such that it is equal to the first pressure ($p_{sH}$) in the third time segment ($\Delta t_4+\Delta t_5$).

17. The device as claimed in claim 12, wherein the hydraulic machine (70) is controlled to tank conveyance between the reversal point (OT) assigned to the commencement ($t_0$) of the work cycle and the commencement ($t_1$) of the first time segment ($\Delta t_2$).

18. The device as claimed in claim 13, further comprising a further nonreturn valve (75) arranged between the second pressure accumulator (31) and the line (73) leading from the hydraulic machine (70) to the inner bottom-side chamber (55$b_i$) of the differential cylinder (55).

* * * * *